US006367296B1

(12) United States Patent
Dupont

(10) Patent No.: US 6,367,296 B1
(45) Date of Patent: Apr. 9, 2002

(54) MOTOR VEHICLE DOOR LOCK THAT CAN BE ELECTRICALLY LOCKED/UNLOCKED FROM THE OUTSIDE AND/OR FROM THE INSIDE

(75) Inventor: Patrick Dupont, Noyelles sur Mer (FR)

(73) Assignee: Valeo Securite Habitacle, Creteil (FR)

( * ) Notice: Subject to any disclaimer, the term of this patent is extended or adjusted under 35 U.S.C. 154(b) by 0 days.

(21) Appl. No.: 09/436,638

(22) Filed: Nov. 9, 1999

(30) Foreign Application Priority Data

Nov. 9, 1998 (FR) ..... 98 14061
Jun. 28, 1999 (FR) ..... 99 08226

(51) Int. Cl.[7] ..... E05B 47/06; E05C 3/06

(52) U.S. Cl. ..... 70/257; 70/278.6; 70/278.7; 292/201; 292/216; 292/DIG. 23; 292/DIG. 25

(58) Field of Search ..... 70/257, 278.6, 70/278.7; 292/201, 216, DIG. 23, DIG. 25

(56) References Cited

U.S. PATENT DOCUMENTS 4,457,148 A * 7/1984 Johansson et al. ..... 70/278.1
5,061,923 A * 10/1991 Miller et al. ..... 70/278.4 X
5,493,882 A * 2/1996 Jasper ..... 70/284 X
5,497,641 A * 3/1996 Linde et al. ..... 70/264 X
5,680,783 A * 10/1997 Kuroda ..... 70/277
5,682,135 A 10/1997 Labonde ..... 340/426
5,697,236 A * 12/1997 Kleefeldt et al. ..... 70/257
5,715,713 A * 2/1998 Aubry et al. ..... 70/277
5,722,272 A * 3/1998 Bridgemen et al. ..... 70/264
5,992,194 A * 11/1999 Baukholt et al. ..... 70/264 X
6,076,383 A * 6/2000 Clark et al. ..... 70/278.1 X
6,286,878 B1 * 9/2001 Hochart et al. ..... 70/257 X

FOREIGN PATENT DOCUMENTS

| | | |
|---|---|---|
| DE | 42 28 233 A1 | 3/1994 |
| DE | 44 35 894 A1 | 4/1996 |
| EP | 0 816 597 A1 | 1/1998 |
| FR | 2 674 895 | 10/1992 |
| GB | 2 200 943 A | 8/1988 |

* cited by examiner

*Primary Examiner*—Lloyd A. Gall
(74) *Attorney, Agent, or Firm*—Connolly Bove Lodge & Hutz, LLP

(57) ABSTRACT

Motor vehicle door lock comprising: a latch cooperating with a striker; a pawl immobilizing the latch in the closed position; a latch-release mechanism comprising a control member that can move in response to actuation of a door handle; an electromechanical locking/unlocking device causing the lock to pass into an unlocked condition in response to an unlocking signal produced by an electronic recognition device; an energy accumulation device is provided, this device including a spring interposed between the control member and the pawl in such a way that when the lock is in the locked condition, the spring stores energy by being stressed by the control member during its actuation movement in response to the actuation of the door handle and so that, when the lock moves into the unlocked condition, the energy stored up in the spring is released and the energy accumulation device causes the pawl to move into its "escaped" position, releasing the latch.

39 Claims, 5 Drawing Sheets

MOTOR VEHICLE DOOR LOCK THAT CAN BE ELECTRICALLY LOCKED/UNLOCKED FROM THE OUTSIDE AND/OR FROM THE INSIDE

BACKGROUND OF THE INVENTION

1. Field of the Invention

The present invention relates to motor vehicle door locks and more particularly to locks which can be locked/unlocked electrically from the outside and/or from the inside.

2. Description of the Related Art

Such locks comprise, as is known, a forked latch intended to cooperate with a striker, a pawl which normally locks the latch in the closed position, a latch-release mechanism comprising a control member which experiences an actuating movement in response to actuation of a handle of the corresponding door of the motor vehicle by the user. The control member may adopt an active position for which it acts, during its actuating movement, on the pawl in order to place it in an "escaped" or "nonobstructing" position (in which said pawl releases the latch), and an inhibited position in which said control member, during its actuating movement, has no effect on said pawl. The lock further comprises an electromechanical locking/unlocking device which responds at least to an unlocking signal by moving said control member from its inhibited position into its active position.

Vehicle door closure systems in which the unlocking signal is generated by actuation of a lock cylinder are known. In other known systems, this unlocking signal is provided by an electronic recognition device in response to an infrared remote-control or radioelectric remote-control signal produced by the user using an appropriate remote control. With these known systems, if the lock is in a locked condition, that is to say if the control member which forms part of the latch-release mechanism is in its inhibited position, two successive actions are then needed in order to open the door: first of all, the lock has to be unlocked using an appropriate means (key, remote control, etc.), then the door has to be opened, for example by pulling on its exterior handle.

It is clear that, when the vehicle is in frequent use, the fact of always having to perform two actions in order to unlock the door and access one's vehicle may be seen as a drawback. Furthermore, insofar as these known systems require the use either of a key or of a remote control, which takes up one of the user's hands, this may also be seen as an encumbrance.

This is why so-called "hands-free vehicle access" systems have already been proposed, these being supposed to allow a user to open a door of his or her vehicle directly by a single action on the exterior handle of the corresponding door, regardless of whether the lock of said door is in the locked or in the unlocked condition, and for this to be achieved without having a key, a remote control or any similar device in his or her hand for unlocking the lock. To this end, these known systems are equipped with an electronic recognition device fitted with a radio emitter and designed to be able to dialog with a radioelectric device, known as the "electronic tag" incorporated into a wristwatch, a credit card, a badge or the like worn or carried by the user. The electronic recognition device does not produce its unlocked signal until it has identified correct ownership.

In such known so-called hands-free access systems, the transmission of the unlocking signal which controls the electromechanical locking/unlocking device, on the one hand, and the actuation of the release mechanism, on the other hand, take place simultaneously. Now, the difference between the relatively long response time of the electromechanical device and the very short response time of the release mechanism is such that said control member, which forms part of the latch-release mechanism, has often completed its actuating movement even though it has not yet been brought into the active position by the electromechanical locking/unlocking device. This means that the user's first action on the door handle does not cause the door to open and that said user has to operate said handle again in order to cause the door to open. This need to operate the door handle twice is obviously a drawback for a system which was supposed to allow the door to be opened in a single action.

French patent application No. 98/05604 filed on May 4, 1998, and corresponding U.S. patent application Ser. No. 09/127,765, entitled "Electrically locked motor vehicle door lock", filed on Jul. 31, 1998, in the name of Hochart et al. and assigned to the same assignee as the present application suggests two solutions for overcoming this drawback. These two solutions consist in using an opening catch-up means which, when the unlocked signal is transmitted roughly at the end of the actuating travel of the control member, brings the pawl into its "escaped" position. In concrete terms, in these two known solutions, the control member which acts on the pawl to make it move into its "escaped" position or an actuating lever, which also forms part of the latch-release mechanism, is configured in such a way as to have a ramped-shaped surface portion which is inclined with respect to the direction of the movement of the control member and which, at the end of the actuating travel of said control member, acts directly or indirectly, according to whether it is the first or second aforementioned solution, in the manner of a cam on the pawl so as to cause it to move into "escaped" position.

BRIEF SUMMARY OF THE INVENTION

The object of the present invention is therefore to provide a solution for avoiding the user having to exert two actions on the door handle with a view to opening this door, and to do so without having to use an excessively powerful electric actuating device for unlocking the lock and causing the pawl to move into its "escaped" position.

To this end, the invention provides an electrically locked/unlocked lock for a hands-free access motor vehicle door, comprising:

a) a forked latch intended to interact with a striker;

b) a pawl which locks the latch in the closed position and which can adopt an "escaped" position in which it no longer acts on the latch;

c) a mechanism for releasing the latch, including a member for operating from the outside which can undergo an actuating movement in response to actuation of a handle on the outside of said door by a user and which, in a condition in which the lock is unlocked from the outside, can, during its actuating movement, act on the pawl to bring it into said "escaped" position;

d) an electromechanical locking/unlocking device including an electric device for actuating from the outside which reacts at least to a signal for locking or unlocking from the outside, so as to cause the lock to move into said condition in which it is locked or unlocked from the outside;

e) an electronic recognition device capable of producing said unlocking signal when it receives an appropriate control signal from, for example, a remote control or an appropriate electronic tag device worn or carried by the owner of the vehicle or by an authorized user;

characterized in that this lock furthermore comprises an energy accumulation device which includes a spring means and which is interposed between said control member and said pawl in such a way that when the lock is in the condition in which it is locked from the outside, said spring means stores up energy by being stressed by said control member during its actuating movement in response to actuation of said exterior door handle and so that when the lock passes into the condition in which it is unlocked from the outside, in response to said unlocking signal, roughly at the end of the actuating travel of said control member, the energy stored up in said spring means is released and the energy accumulation device causes said pawl to move into its "escaped" position.

This being the case, when the electronic recognition device identifies the correct owner or an authorized user and when the latter pulls on the door handle, the pawl is automatically brought into its "escaped" position and the latch is released, by virtue of the "free" energy stored up in the spring means when actuating the door handle. The result of this is that the electric drive device designed to lock/unlock the lock and consisting, for example, of an electromagnet or of an electric motor, can be of a smaller size and power because it is no longer used to cause the pawl to move into its "escaped" position to release the latch, but only to unlock the lock.

In one embodiment of the present invention, said energy accumulation device includes a first pivoting lever which is attached to said control member and pivots about a first axle under the action of said control member, a second pivoting lever which is mounted so that it can pivot on said first axle and which cooperates with the pawl so as to carry it along with it in its pivoting movement, and said spring means which is mounted between the two pivoting levers.

When the lock is in the condition in which it is unlocked from the outside, the electromechanical locking/unlocking device couples the first and second pivoting levers together in such a way that they pivot together about said first axle under the action of said control member. When the lock is in the condition in which it is locked from the outside, said electromechanical locking/unlocking device prevents the second lever from pivoting so that the spring means is stressed by the first lever when it pivots under the action of said control member.

In one embodiment of the invention, the second pivoting lever may have first and second tabs which are spaced apart in a tangential direction with respect to the pivoting movement of said second lever and which project from one face of this second lever some distance from said first axle. The second lever also has a first oblong slot which extends in the longitudinal direction of the second lever between said first axle and the first and second tabs.

In this embodiment, the first pivoting lever passes between the first and second tabs of the second pivoting lever and has a third tab which projects from one face of this first lever some distance from said first axle and which rests against the first tab of the second lever when there is no action on the door handle. The first pivoting lever also has a roughly L-shaped second slot with two parts, one of the two parts of which coincides with the first oblong slot of the second lever when said third tab is resting on said first tab. Said spring means may then be arranged between said second and third tabs, and may consist of a helical spring.

The electromagnetic locking/unlocking device may comprise a lever for locking from the outside which is coupled to the electric device for actuating from the outside and which is mounted so that it can pivot on a second axle which is parallel to said first axle. In this case, the lever for locking from the outside may have an immobilizing finger which, when the lock is in the condition in which it is locked from the outside, cooperates with the second tab of the second pivoting lever to prevent the latter from pivoting. As a preference, when the lock is in the condition in which it is locked from the outside, said first and second tabs of the second pivoting lever, said immobilizing finger and the center of said second axle are aligned.

The electromechanical locking/unlocking device may further comprise a link rod, a first end of which is coupled to the first and second pivoting levers by a first stub which is engaged in the first and second slots of said first and second pivoting levers and causes them to rotate as one when the lock is in the condition in which it is unlocked from the outside. The second end of the link rod is coupled to said locking lever by a second stub which is engaged in a third oblong slot made in this locking lever. This third slot is at lease approximately aligned with the first oblong slot of the second pivoting lever when the lock is in the condition in which it is unlocked from the outside. The second stub is able to move in the third slot against the return force of a spring which urges the link rod in one direction such that its first stub comes to be positioned at that one of the two ends of said first oblong slot which is furthest from said first axle.

Advantageously, the electromechanical locking/unlocking device comprises an electrical device for actuating from the inside which reacts to a signal for unlocking from the inside so as to cause the lock to move into a condition in which it is unlocked from the inside, in which lock, actuation of an interior door handle by a user acts on the latch-release mechanism to bring the pawl into the escaped position, and reacts to a signal to lock from the inside, to cause the lock to pass into a condition in which it is locked from the inside, in which condition of the actuation of the interior door handle and of lock stalk have no effect on the release mechanism, said electromechanical locking/unlocking device comprising a lever for locking from the inside which is coupled to said electrical device for actuating from the inside, said lever for locking from the inside being mounted so that it can pivot on an axle and having a first oblong aperture, roughly in the shape of an arc of a circle, through which there passes a drive peg which is also received in a second oblong aperture extending roughly at right angles to the first oblong aperture, in the lever for locking from the outside, so that pivoting of either said lever for locking from the inside or said lever for locking from the outside causes the free sliding of the drive peg in the oblong aperture of the other of said levers namely either the lever for locking from the inside or the lever for locking from the outside.

In one particular embodiment, the lock comprises an additional lever for automatically unlocking from the outside when opened from the inside, said additional lever being mounted so that it can pivot on said second axle and comprising a first branch capable of cooperating with the interior door handle, said additional lever cooperating with the lever for locking from the outside to cause it to pivot into its unlocked from the outside position when the interior door handle is actuated. In this case, said additional lever may comprise a second branch capable of cooperating with an interior lock stalk to cause the lever for locking from the outside to pivot into its locked from the outside position when the lock stalk is actuated into its locked from the outside position.

According to another characteristic, the additional lever and the lever for locking from the outside are coupled in terms of rotation in the unlocked from the inside position and are uncoupled in terms of rotation in the locked from the inside position. In this case, the additional lever may comprise a third roughly L-shaped aperture, a first part of which corresponds to said second oblong aperture of the lever for locking from the outside and a second part of which corresponds to the first oblong aperture of the lever for locking from the inside, in the locked from the inside position, said third aperture having the aforementioned drive peg passing through it. As a preference, the additional lever is interposed between the lever for locking from the inside and the lever for locking from the outside.

Advantageously, the electromechanical locking/unlocking device is capable of reacting to an unlocking signal so as to cause the lock to move from a deadlocked condition into a condition in which it is unlocked from the inside and from the outside.

The supply of electric current to the electric actuating device may be obtained using a switch which is normally open and the closure of which is brought about in response to the transmission of the unlocked signal, this switch closing an electric circuit that supplies the electric actuating device with power.

As a preference, the electronic recognition device is supplied with electrical power only during the opening action exerted on the door handle by the user. This thus avoids powering the electronic recognition device constantly and it needlessly consuming energy.

To this end, the supply of electric current to the electronic recognition device can be achieved using a control system such as a microswitch which is normally open, closure of which is brought about by said opening action exerted on the door handle, this microswitch closing a circuit for supplying the electronic recognition device with electrical power.

Other features and advantages of the invention will become clear from reading the description, given hereinbelow by way of nonlimiting indication, of two preferred embodiments of the lock according to the invention, with reference to the appended drawings, in which:

DETAILED DESCRIPTION OF THE INVENTION

Figure 1:
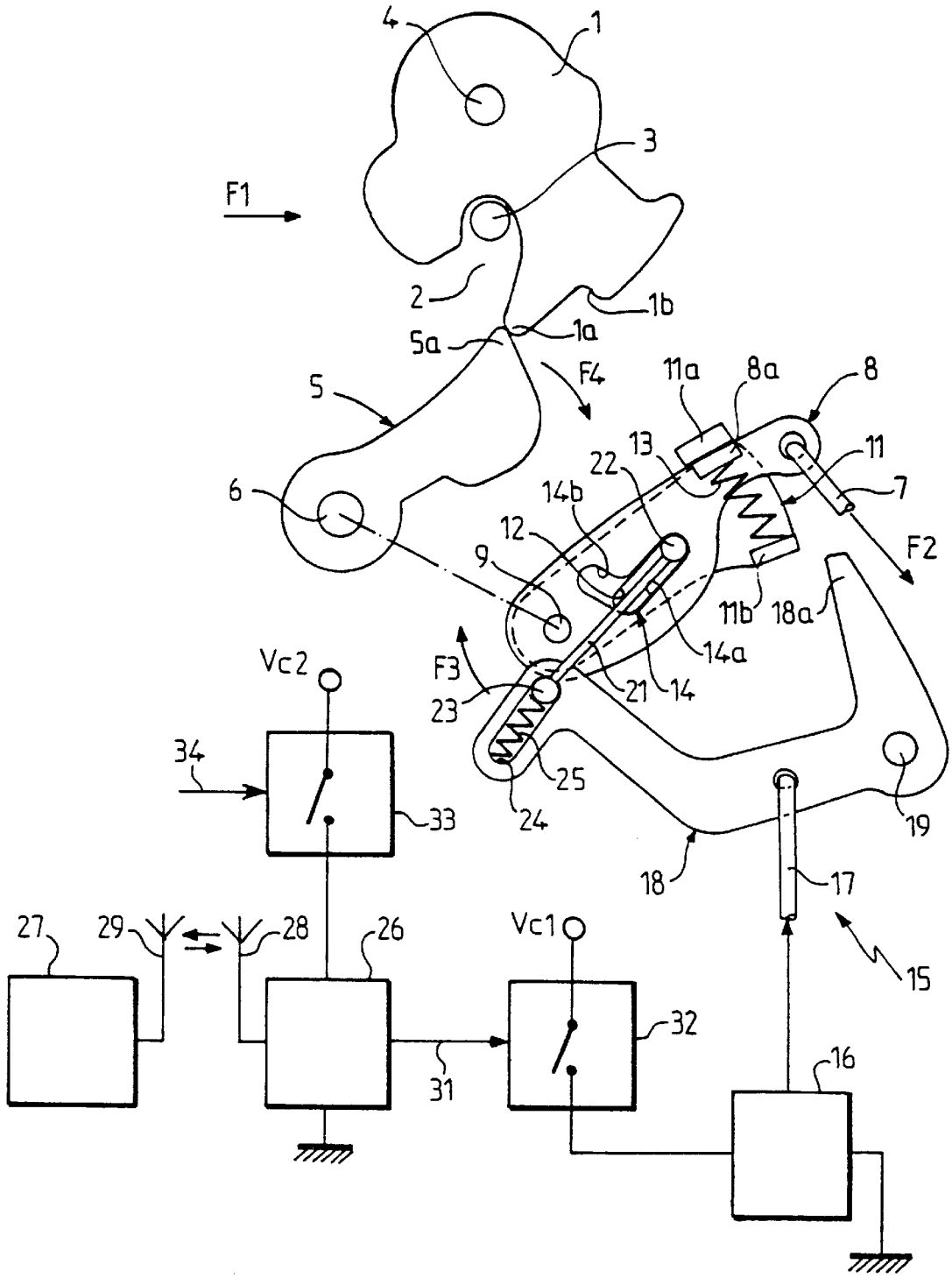
FIG. 1 depicts a partial view of a first embodiment of the lock, partly in elevation and partly in the form of a functional diagram, in the unlocked position.

Referring to FIG. 1, it can be seen that the first embodiment of the lock according to the invention comprises a forked latch 1, the fork of which delimits a roughly V-shaped housing 2 which is intended to accommodate a striker 3 which cooperates with the lock. As is known, the striker 3 may be formed of a stub which projects from a stationary upright of a door of a motor vehicle opposite the lock borne by said door. The relative movement of the door with respect to the door upright, in the direction for closing the door, corresponds to a relative movement of the striker 3 in the direction of the arrow F1 of FIG. 1.

The latch 1 is able to pivot about an axle 4 and, when the lock is in the closed condition, cooperates with a pawl 5 which can pivot about an axle 6. The pawl 5 is subject to an elastic return force which pushes it toward the latch 1. This elastic return force may be produced by a spring (not depicted), for example a torsion spring borne by the axle 6.

When, upon closing the door, latch 1 is pushed back against an elastic return force acting on it in the position in which it is depicted in FIG. 1, the pawl 5 comes to rest via its tip 5*a* against a shoulder 1*a* formed on the latch 1. Thus, the latch 1 is held in the position it occupies in FIG. 1 and the striker 3 is trapped in the recess 2, and this keeps the door closed.

As is known, the latch 1 may comprise a second shoulder 1*b*, which corresponds to a slightly open, but locked, position of the door, when this shoulder cooperates with the tip 5*a* of the pawl 5.

The lock further comprises a release mechanism which, under certain conditions which will be described later on, allows the latch 1 to be released, by causing the pawl 5 to move into an "escaped" or "nonobstructing" position for which it no longer immobilizes the latch 1 and therefore allows the door to be opened. This mechanism, which is only partially depicted in FIG. 1, comprises, as is known, a control member 7 which is mechanically connected to the door handle (not shown) so that it can be actuated by this handle when the user pulls on it, more specifically, when the user pulls on a mobile flap of said handle.

In the embodiment depicted in FIG. 1, the control member 7 consists of a linkage, the upper end of which is attached to a pivoting lever 8 which can pivot about an axle 9 under the action of the control linkage 7. In FIG. 1, the arrow F2 indicates the direction of travel of the control linkage 7 when the user pulls on the door handle.

A second lever 11 is mounted to pivot on the axle 9 and is coupled to the pawl 5 in such a way as to carry it along with it in its pivoting movement. In the simplest embodiment, the two axles 6 and 9 may, for example, be coincident or aligned with one another. In this case, the pawl 5 and the lever 11 can be made as a single piece or in the form of two distinct pieces which are fastened together when the lock parts are being assembled and which are fitted with complementary elements (for example a tenon and a mortise) which are fitted together at the time of said assembly of these two parts so as to make them rotate as one. In another embodiment of the invention, the two axles 6 and 9 may be separate and arranged parallel to one another and the lever 11 may act on the pawl 5 either directly, for example by pushing, or by means of a motion transmission system, such as, for example, a link rod forming a parallelogram articulated to the pawl 5 and the lever 11, or alternatively a set of gears borne by the axles 6 and 9.

The lever 11 has, projecting from one of its faces and some distance from the axle 9, two tabs 11*a*, 11*b* which are spaced apart in a tangential direction with respect to the pivoting movement of this lever 11 about the axle 9. The lever 11 further comprises an oblong aperture 12 which, roughly speaking, extends in the longitudinal direction of said lever 11, between the axle 9 and the pair of tabs 11*a*, 11*b*.

Figure 2:
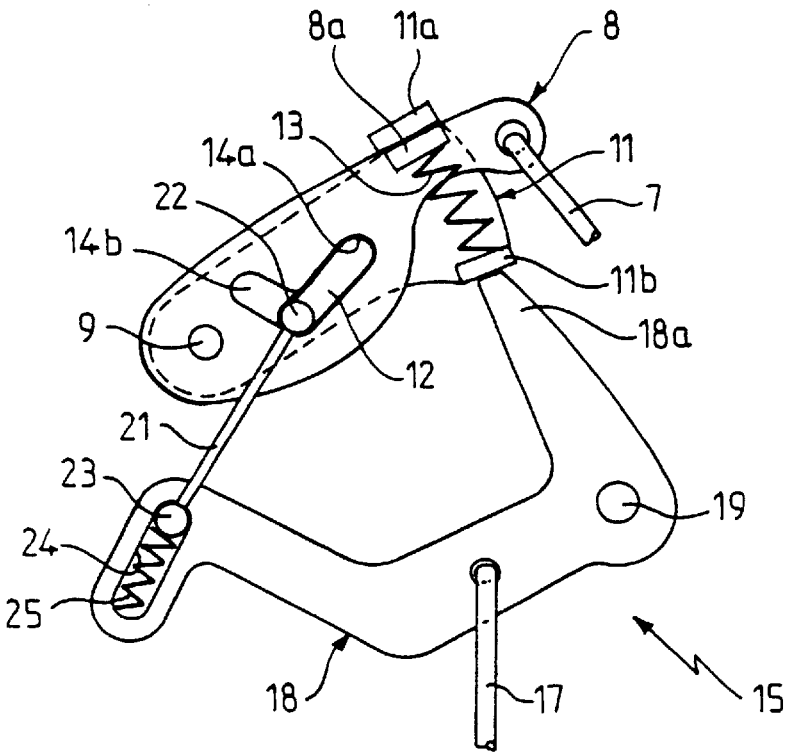
FIG. 2 is a view similar to FIG. 1, depicting the lock in the locked from the outside position.

As shown in the figures, the lever 8 passes between the two tabs 11*a* and 11*b* of the lever 11 and itself has a tab 8*a* which projects from one of its faces some distance from the axle 9 and which, in the absence of any action on the door handle, is kept resting against the tab 11*a* of the lever 11 by a spring means 13, for example a helical spring. The opposite end of the spring 13 rests against the tab 11*b* of the lever 11. The lever 8 also comprises a slot 14 with two parts 14*a* and 14*b* arranged at right angles. The part 14*a* of the slot 14 coincides with the oblong slot 12 of the lever 11 when the tab 8*a* is resting on the tab 11*a* as shown in FIGS. 1 and 2.

As will be explained in detail later on during the description of the operation of the lock, the two levers 8 and 11 and the spring 13 together constitute an energy accumulation device which couples the control linkage 7 to the pawl 5.

The lock according to the invention further comprises, as is known, an electromechanical locking/ unlocking device 15 comprising an electric actuating device 16 which allows the lock to be brought selectively either into a locked condition or into an unlocked condition. This electric actuating device 16 may, in a way known per se, consist for example of an electromagnet which is coupled, for example by a linkage 17, to a locking lever 18 which can pivot on an axle 19. Thus, the lever 18 can be placed selectively either in the position depicted in FIG. 1, which corresponds to the lock being in the unlocked condition, or into the position depicted in FIG. 2, which corresponds to the lock being in the locked condition.

When the lock is in the locked condition, a finger 18*a* for immobilizing the lever 18 faces the tab 11*b* of the lever 11 and prevents this lever from pivoting about the axle 9. The tab 11*b* of the lever 11, the immobilizing finger 18*a* and the center of the axle 19 are preferably aligned so as to provide the lever 11 with rigid support when the lock is in the locked condition, if an unauthorized individual starts pulling on the door handle. Under these conditions, actuation of the control linkage 7 in response to actuation of the door handle has no effect on the pawl 5 and the lock remains locked, which means that the door cannot be opened.

The electromechanical locking/unlocking device 15 further comprises a link rod 21, the ends of which are respectively fitted with stubs 22 and 23. One of the ends of the link rod 21 is coupled to the levers 8 and 11 by the stub 22 which is engaged in the slots 12 and 14 of said levers. When the lock is in the unlocked condition (FIG. 1), the stub 22 is at the end of the slot 12 of the lever 11 and at the corresponding end of the part 14*a* of the slot 14 of the lever 8, which are furthest from the axle 9. In this position, the stub 22 of the link rod 21 couples the two levers 8 and 11 in such a way that they can pivot together about the axle 9 under the action of the control linkage 7.

When the lock is in the locked condition (FIG. 2), the stub 22 of the link rod 21 is at that end of the slot 12 which is closest to the axle 9. In this position, the two levers 8 and 11 are uncoupled. What happens is that if the lever 8 is pivoted about the axle 9 by the control linkage 7 in response to actuation of the door handle, the stub 22 engages in the part 14*b* of the slot 14, which means that the lever 11 is not carried along with the lever 8. Of course, the total amplitude of the pivoting movement of the lever 8 about the axle 9, which corresponds to the total travel of the control linkage 7 in response to actuation of the door handle must be such that the stub 22 of the link rod 21 never comes into contact with the end of the part 14*b* of the slot 14 and such that the lever 8 never comes into contact with the tab 11*b* of the lever 11.

The other end of the link rod 21 is coupled to the locking lever 18 by the stub 23 which is engaged in an oblong slot 24 of the lever 18. As shown in FIG. 1, the oblong slot 24 is at least approximately aligned with the oblong slot 12 of the lever 11 and also with the part 14*a* of the slot 14 of the lever 8, when the lock is in the unlocked condition. The stub 23 of the link rod 21 can move in the slot 24 against the action of the return force of a spring 25 which urges the link rod in a direction such that its stub 22 comes to be positioned at that end of the slot 12 which is furthest from the axle 9.

To allow hands-free access to the vehicle, that is to say to allow the user to open the door of his or her vehicle by one single action on the door handle, without the user having to use a key or a remote control to unlock the lock beforehand, if this lock was in a locked condition, an electronic recognition device 26 (FIG. 1) is associated with the lock to cause it to pass into an unlocked condition when it recognizes an appropriate electronic tag device 27 worn or carried by the owner of the vehicle or by an authorized user. This electronic recognition device 26 comprises, in the known way, a radio transmitter equipped with an antenna 28, which may, for example, be housed in the door handle and by means of which it can dialog, according to a predefined appropriate protocol, with a radioelectric device, also fitted with an antenna 29, of the electronic tag device 27. This device 27 may, in a known way, be incorporated into a wristwatch or a card or a badge worn or carried by the user.

When the electronic recognition device 26 recognizes the correct owner or an authorized user, it transmits on its output an unlocking signal which is sent by the line 31 to the electromechanical locking/unlocking device 15 described above, with a view to unlocking the lock. For example, in the embodiment depicted in FIG. 1, in response to the unlocking signal present on the line 31, a switch 32 closes and thus makes a circuit for supplying the electric actuating device 16, for example an electromagnet, with power from a voltage source Vc1.

Usually, transmission of the unlocking signal which controls the electric actuating device 16, on the one hand, and actuation of the latch-release mechanism, that is to say actuation of the door handle and consequently actuation of the control linkage 7, on the other hand, take place simultaneously or more or less simultaneously. This is particularly true when, in order to avoid needless consumption of electrical power, the electronic recognition device 26 is powered with electric current only when the user is exerting action on the door handle in order to open the door. For this purpose, as shown in FIG. 1, the electronic recognition device 26 is electrically connected to a dc voltage source Vc2, for example via a microswitch 33, which is normally open and which can be closed in response to said action on the door handle, as symbolized by the arrow 34.

The total time taken by the electronic recognition device 26 to dialog with the device 27, identify the correct owner and transmit the unlocking signal, plus the time taken by the electromechanical locking/unlocking device 15 to move the lever 18 and the stub 22 from their position corresponding to the locked condition (FIG. 2) into their position corresponding to the unlocked condition of the lock (FIG. 1), in response to the transmission of the unlocking signal, is generally longer than the response time of the mechanism for releasing the latch 1, that is to say the time taken by the control linkage 7 to cover its actuating travel in response to actuation of the door handle. The control linkage 7 has therefore generally finished its actuating movement while the lever 18 and the stub 22 have not yet been brought into the position corresponding to the lock being in the unlocked condition. At this instant, despite the transmission of the unlocking signal, the actuating movement of the control linkage 7 has no effect on the pawl 5.

The energy accumulation device formed by the levers 8 and 11 and by the spring 13 makes it possible to remedy that, as will be seen now in the course of the description of the operation of the lock according to the invention.

If the lock is in the unlocked condition (FIG. 1), the two levers 8 and 11 are secured to one another by the link rod 21 and its stub 22, as indicated above. As a result of this, if the user pulls on the door handle, the control linkage 7 moves in the direction of the arrow F2 and causes the lever 8 to pivot in the direction of the arrow F3, and this lever carries along with it the lever 11, which itself drives the pawl 5, causing it to pivot in the direction of the arrow F4 about the axle 6, thus releasing the latch 1. The door can then be opened by continuing to pull on the door handle.

Figure 3:
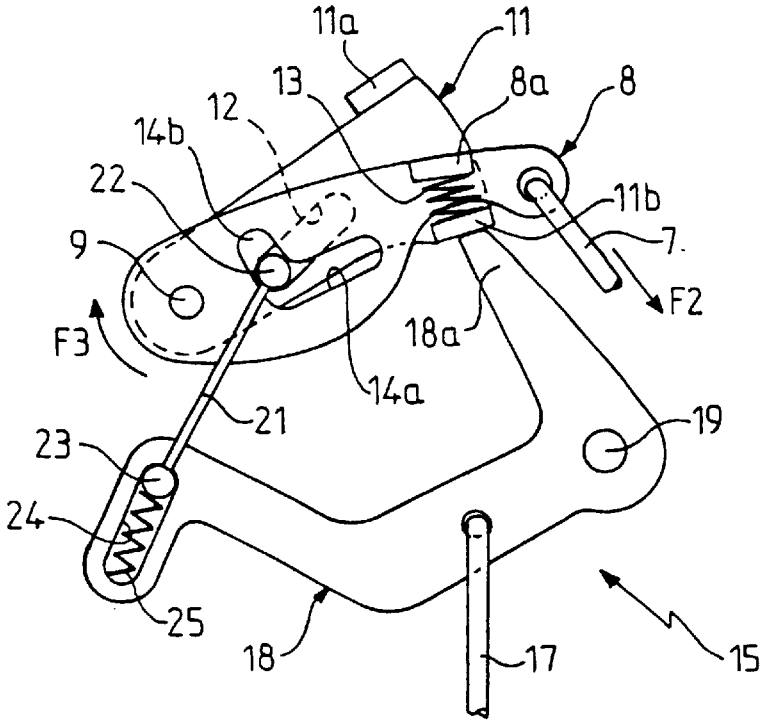
FIG. 3 is a view similar to FIG. 2, but depicting the lock at the end of the actuation of the exterior door handle.

If the lock is in the locked condition (FIG. 2) and if an unauthorized individual pulls on the door handle, the control linkage 7, in this case also, causes the lever 8 to pivot in the direction of the arrow F3 about the axle 9 (FIG. 3). However, in this case, because the stub 22 of the link rod 21 is now at that end of the slot 12 which is closest to the axle 9, facing the part 14*b* of the slot 14 of the lever 8, the latter does not, in its pivoting movement, carry the lever 11 along with it because the stub 22 enters said part 14*b* of the slot 14. Furthermore, during the pivoting movement of the lever 8, the spring 13 is compressed and thus tends to cause the lever 11 to turn in the direction of the arrow F3 about the axle 9, but this lever 11 does not turn, given that the locking lever 18 prevents it from doing so because its finger 18*a* is in abutment against the tab 11*b* of the lever 11. The latter is therefore immobilized and the pawl 5 cannot be brought into its "escaped" or "nonobstructing" position, which means that the striker 3 remains trapped by the latch 1 and that the door cannot be opened.

Figure 4:
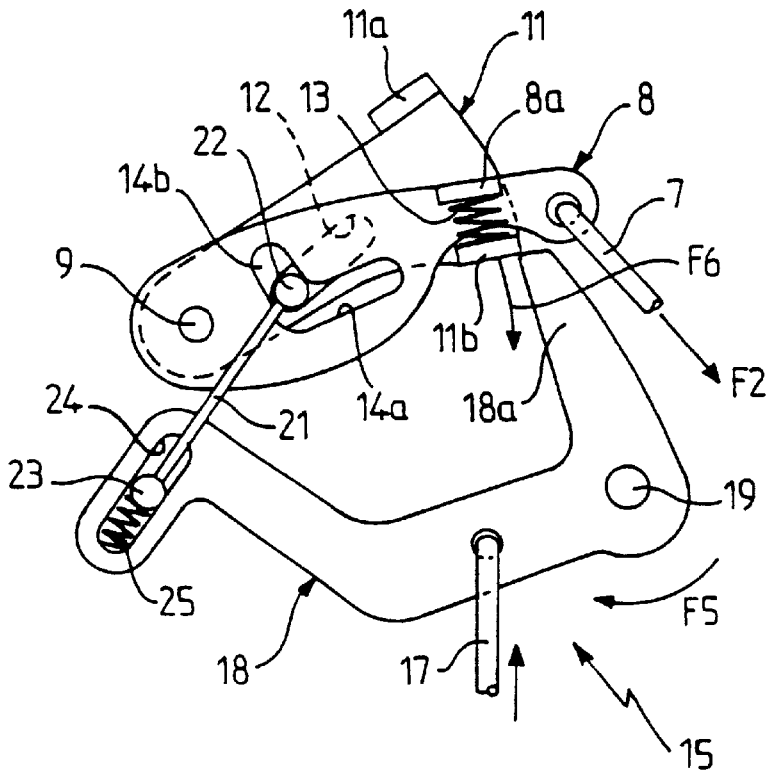
FIG. 4 is a view similar to FIG. 3, depicting the movement for unlocking the lock.
Figure 5:
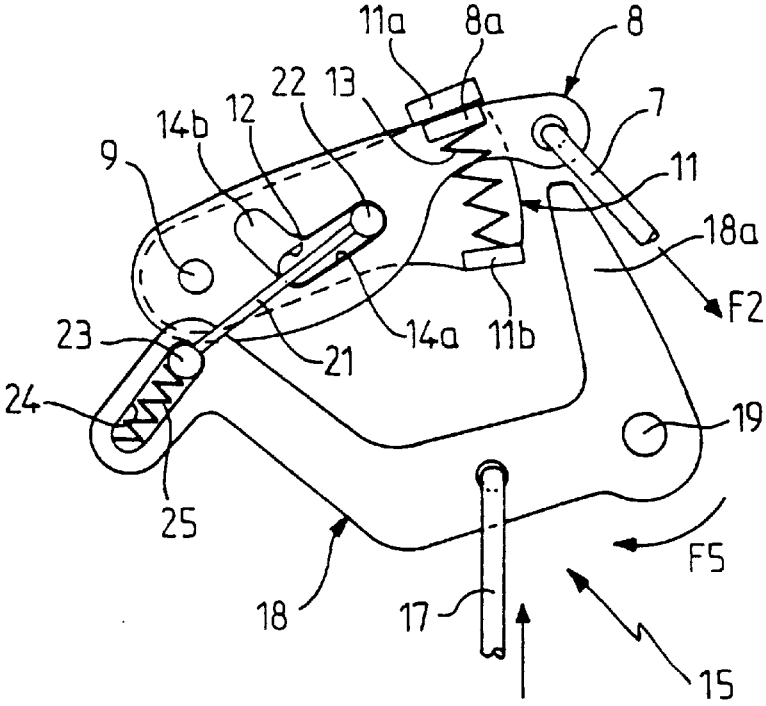
FIG. 5 is a view similar to FIG. 4, showing the lock into unlocked and open position.

If the lock is in a locked condition (FIG. 2) and the owner of the vehicle or an authorized individual wearing or carrying an appropriate electronic tag 27 pulls on the door handle, initially, exactly the same occurs as occurred in the previous scenario. The lever 8 pivots about the axle 9, the spring 13 is compressed, but the lever 11 remains immobilized by the finger 18*a* of the locking lever 18. In a second phase which occurs very soon after the first phase, the individual having been recognized by the electronic recognition device 26, the latter activates the electric actuating device 16 (for example an electromagnet) which acts via the linking rod 17 on the locking lever 18 to cause it to pivot in the direction of the arrow F5 about the axle 19 (FIG. 4) and bring it into the unlocked position (FIG. 5). During this rotational movement of the lever 18, as soon as its finger 18*a* has released the tab 11*b* of the lever 11 (FIG. 4), the latter is almost instantly driven round in the direction of the arrow F6 about the axle 9, by virtue of the free energy supplied by the user and stored up in the spring 13 during the first phase. In pivoting in the direction of the arrow F6, the lever 11 carries with it the pawl 5. The latter therefore releases the latch 1, so that the door can be opened.

It will be noted that very shortly after the start of the rotational movement of the lever 18 in the direction of the arrow F5 about the axle 19, the tab 11*b*, the finger 18*a* and the center of the axle 19 cease to be aligned and, under the action of the spring 13 pushing the tab 11*b* against the end of the finger 18*a* of the lever 18, this finger 18*a* experiences a force, whose moment with respect to the axle 19 is no longer zero and also tends to rotate the lever 18 in the direction of the arrow F5, thus assisting the electric actuating device 16 in turning the lever 18 in order to bring it into its unlocked position. What this means is that the electric actuating device 16 does not need to supply a significant amount of energy, because all it needs to do, in addition to the locking function, is overcome the small amount of friction between the tab 11*b* and the end of the finger 18*a* of the lever 18 at the start of the unlocking movement of this lever 18.

At the same time as the lever 18 begins to turn toward its unlocked position (FIG. 4), its slot 24 moves and compresses the spring 25, because the link rod 21 cannot turn given that, at this moment, its stub 22 is pressed against the edge of the part 14*b* of the slot 14 of the lever 8. As soon as the tab 11*b* of the lever 11 is released by the finger 18*a* of the locking lever 18, and the lever 11 pivots in the direction of the arrow F6, its slot 12 acts on the stub 22 of the link rod 21 so as to return it toward the branch 14*a* of the slot 14 of the lever 8. As soon as the slot 12 of the lever 11 coincides with said part 14*a* of the slot 14, the stub 22 of the link rod 21 is pushed back by the spring 25 as far as the end of the part 14*a* of the slot 14 that is furthest from the axle 9 (FIG. 5). Thus, when the door handle is subsequently released, the lock is in an unlocked condition.

In order that the user, at the moment of pulling on the door handle, should have roughly the same sensation, irrespective of whether the lock is locked or unlocked, the spring 13 is preferably fitted between the two tabs 8*a* and 11*b* so that when the lock is in the condition depicted in FIG. 1 or 2, it is in a prestressed or preloaded condition such that the effort to be provided by the user to compress the spring when the lock is in the locked condition is the same or roughly the same as the effort to be provided by the user to overcome the friction between the pawl 5 and the latch 1 when the lock is unlocked.

With the lock described hereinabove, it can thus be seen that the latch 1 can be released reliably by a single action on the vehicle door handle in response to the transmission of the unlocking signal produced by the electronic recognition device 26, and that this is true irrespective of whether the lock is in the locked or in the unlocked condition.

In the event that the vehicle is equipped with a central locking/unlocking system, the unlocking signal emitted on the line 31 may also be used to unlock the locks of the other doors or opening leaves of the vehicle.

A second embodiment of the lock of the invention will now be described with reference to FIGS. 6 to 12. In this embodiment, the elements which are identical or similar to those of the first embodiment bears the same reference numerals increased by 100.

In these figures, only the actuating peg 105 of the pawl is depicted. In a way known per se, this peg 105 passes through an elongate aperture formed in a wall separating the retaining compartment of the lock, which in particular contains the latch and the pawl, from the kinematics compartment containing the levers for opening and locking the lock.

Figure 6:
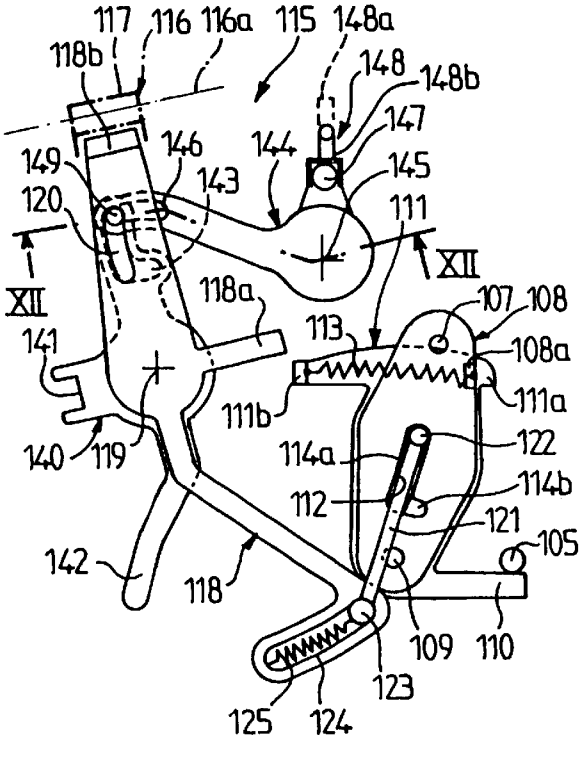
FIG. 6 is a partial view of a second embodiment of the lock of the invention in an unlocked condition.

In FIG. 6, the exterior door handle is intended to be connected, by a control member consisting, for example, of a linkage, to one end 107 of a pivoting lever 108. This pivoting lever 108 is mounted so that it can pivot on an axle 109, at the opposite end to the end 107. The lever 108 is intended to pivot in the counterclockwise direction when the user exerts a pulling force on the door handle.

A second lever 111 is mounted so that it can pivot on the axle 109 and comprises a branch 110 capable of cooperating with the pawl peg 105 to carry it along with it in its pivoting movement.

The lever 111 comprises, projecting from one of its faces and some distance from the axle 109, two tabs 111*a* and 111*b* which are spaced apart so as to receive the aforementioned lever 108 between them. The lever 111 further comprises an oblong slot 112 which extends roughly in a radial direction with respect to the axle 109. The lever 108 also has a tab 108*a* which projects from one of its faces some distance from the axle 109 and which is kept pressed against the tab 111*a* of the lever 111 by an elastic compression means 113, for example a helical spring. The spring 113 at its opposite end rests against the tab 111*b* of the lever 111. The lever 108 also has a roughly L-shaped slot 114 comprising two parts 114*a* and 114*b*. The part 114*a* coincides with the oblong slot 112 when the tabs 108*a* and 111*a* are resting against each other, as illustrated in FIGS. 6 to 8.

The electromechanical locking/unlocking device 115 here comprises an electric device for actuating from the outside 116 which comprises, for example, an electric motor which, via a set of gears, drives a worm 116*a* depicted as an axis in FIG. 6, on which there slides axially a nut 117 bearing a pair of branches forming a fork capable of moving a tab 118*b* bent over at right angles belonging to a lever for locking from the outside (LLO) 118, said tab 118*b* passing through a wall separating the kinematics compartment and the electrical compartment of the lock, in which the aforementioned electromechanical device 115 is housed.

This electromechanical device 115 further comprises an electric device 148 for actuating from the inside which comprises, in a way known per se, an electric motor connected by a set of gears to a lever 148*a* depicted in broken line in FIG. 6, located in the electrical compartment of the lock, this lever 148*a* rotating as one, because of an axle passing through said dividing wall, with a fork 148*b* capable of moving the lever for locking from the inside (LLI) 144, the operation of which will be explained later on.

Figure 8:
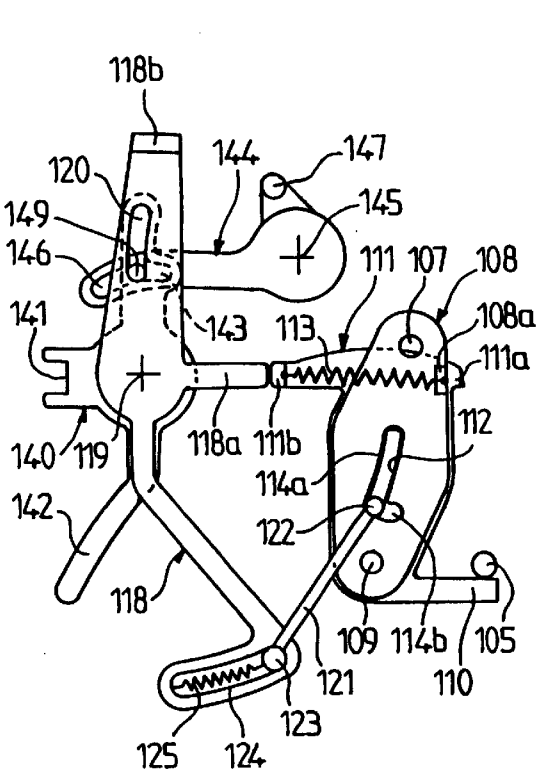
FIG. 8 is a view similar to FIG. 7, the lock being in a deadlocked condition.
Figure 7:
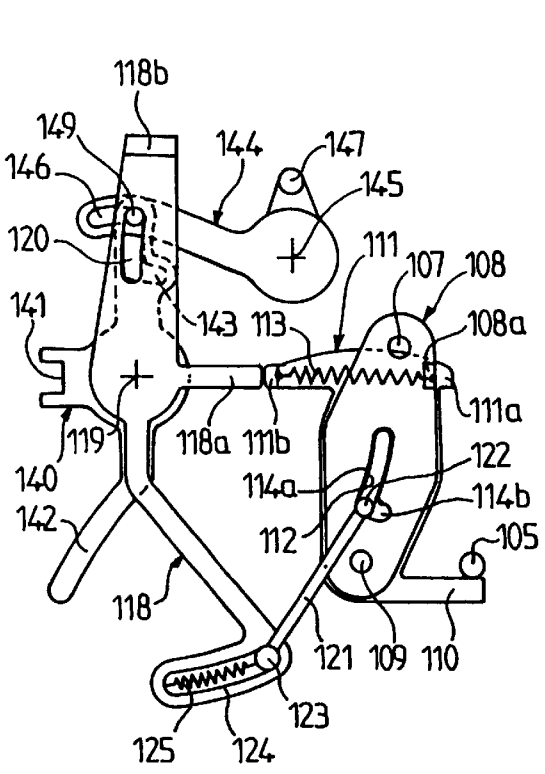
FIG. 7 is a view similar to FIG. 6, but with the lock in the locked from the outside position.

The LLO 118 is mounted so that it can pivot on an axle 119 parallel to the aforementioned axle 109, and includes an immobilizing finger 118*a* which faces the tab 111*b* of the lever 111 when the lock is in the condition in which it is locked from the outside, as illustrated in FIGS. 7 and 8, thus preventing the lever 111 from pivoting about the axle 109.

A link rod 121 has stubs 122 and 123 at its two ends, the stub 122 being engaged in the slots 112 and 114 of the levers 111 and 108, while the other stub 123 is engaged in an oblong slot 124 of the LLO 118. The stub 123 can move in the slot 124 against the return force of a spring 125.

The LLO 118 comprises, on its opposite branch to the one which has the slot 124, an oblong aperture 120, roughly in the shape of an arc of a circle, extending roughly radially between the axle 119 and the tab 118*b* of the LLO 118. The aperture 120 is roughly at right angles to the immobilizing finger 118*a*.

Figure 9:
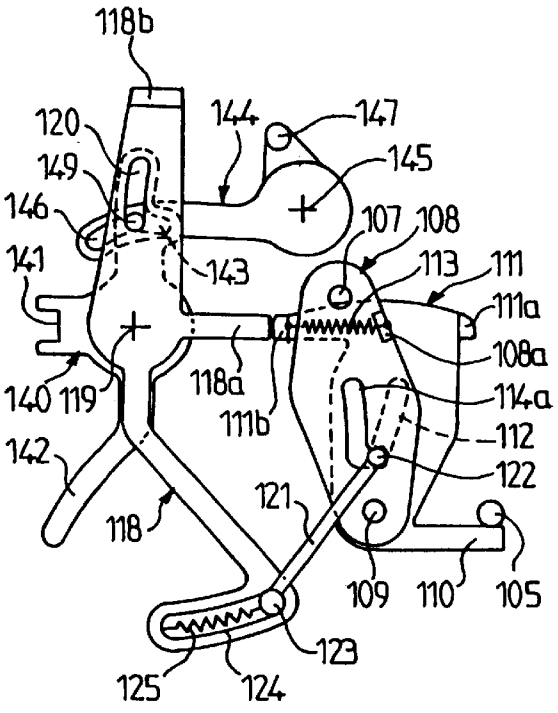
FIG. 9 is a view similar to FIG. 8, at the end of the actuating movement of an exterior door handle.

The LLI 144 is mounted so that it can pivot on an axle 145 parallel to the aforementioned axle 119 and comprises an eccentric finger 147 capable of being moved by the fork 148*b* of the device 148 for actuating from the inside, so as to cause the LLI 144 to pivot between an unlocked from the inside position illustrated in FIGS. 6 and 7 and a locked from the inside position illustrated in FIGS. 8 and 9. The LLI 144 comprises, on one branch, an oblong aperture 146 extending roughly at right angles to the aperture 120 of the LLO 118. As better visible in FIG. 12, the aperture 120 of the LLO 118 and the aperture 146 of the LLI 144 have a drive or coupling peg 149 passing through them.

Figure 12:
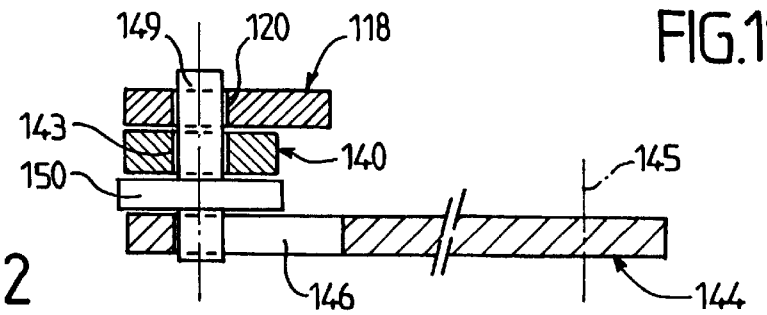
FIG. 12 is a partial enlarged view in section on the line XII—XII of FIG. 6.

The lock according to this second embodiment of the invention further comprises an additional lever 140 mounted so that it can pivot on the aforementioned axle 119 and interposed between the LLO 118 and the LLI 144, as illustrated in FIG. 12. The lever 140 comprises a fork 141 in which a means of connection to a door interior lock stalk can be inserted. The lever 140 further comprises an actuating ramp 142 capable of cooperating with a control member for opening the door from the inside, to cause the lever 140 to pivot in the counterclockwise direction. The lever 140 further comprises a roughly L-shaped aperture 143, one part of which corresponds to the aperture 120 of the LLO 118, and the other part of which corresponds to the aperture 146 of the LLI 144, in the locked from the inside position.

It may be noted that in the absence of the device for actuating from the inside 144 to 149, the LLO 118 can integrate the ramp 142 and the fork 141 without any additional lever. In this case, the lock does not have the deadlock function in which the lock is locked from the inside and from the outside.

The drive peg 149 has a larger-diameter intermediate collar 150 interposed between the LLI 144 and the additional lever 140, to immobilize the drive peg 149 in terms of axial position with respect to the various levers.

The way in which this lock works will now be described with reference to FIGS. 6 to 11.

In FIG. 6, the lock is in a condition in which it is unlocked from the inside and from the outside. Under manual action by the user seated inside the vehicle, on a door interior lock stalk acting on the fork 141, the lever 140 is pivoted in the clockwise direction, and this, via the drive peg 149, causes the LLO 118 to pivot in the clockwise direction until its immobilizing finger 118*a* comes to face the tab 111*b* of the lever 111, as illustrated in FIG. 7. The pivoting of the LLO 118 causes the nut 117 to slide along its worm 116*a* which can rotate freely with respect to its electric motor, and the drive peg 149 can slide freely in the oblong aperture 146 of the LLI 144, without moving the latter.

From the position illustrated in FIG. 7, a user can actuate the interior door handle, and this causes the pawl 105 to move into its escaped position, while acting on the ramp 142 of the lever 140 to cause it to pivot in the counterclockwise direction. This pivoting of the lever 140 causes the LLO 118 to pivot in the counterclockwise direction as far as its unlocked position illustrated in FIG. 6. The ramp 142 therefore forms a means of automatically unlocking the lock as the door is opened when the door is not locked from the inside.

To get from FIG. 6 to FIG. 7 it is also possible to send the vehicle a signal to lock from the outside so as, by way of the electric motor, to cause the nut 117 to move, leading to the pivoting of the LLO 118 in the clockwise direction as far as its locked from the outside position. In this case, the fork 141 of the lever 140 causes the lock stalk to move into its locked position.

By contrast, when the vehicle receives a signal to lock from the inside, the associated electric motor causes the fork

148*b* to pivot so as to make the LLI 144 pivot in the counterclockwise direction as far as its position illustrated in FIG. 8. During the pivoting of the LLI 144, the drive peg 149 slides freely in the superposed oblong apertures 120 and 143 of the levers 118 and 140. In the locked from the inside position, the drive peg 149 is opposite the other portion of the L-shaped aperture 143 of the lever 140. Thus, if a user actuates the interior door handle or the lock stalk, the pivoting of the lever 140 in the counterclockwise direction does not cause the LLO 118 to pivot, which means that the automatic unlocking upon opening function has been suppressed. The driveline of the mechanism for opening and for locking from the inside is not depicted and is known per se.

From the position illustrated in FIG. 8, if a user actuates the exterior door handle, the lever 108 pivots in the counterclockwise direction, and this compresses the spring 113 because the lever 111 is immobilized in terms of rotation by the finger 118*a* of the LLO 118, as illustrated in FIG. 9.

Figure 10:
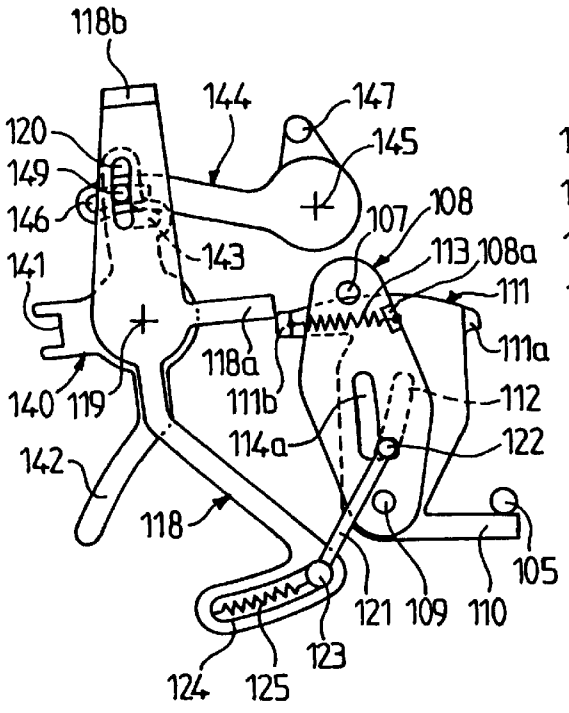
FIG. 10 is a view similar to FIG. 9, during the movement for unlocking the lock.

When the vehicle receives an unlocking signal, the electric motors are powered to unlock both from the inside and from the outside, as illustrated in FIG. 10. Specifically, in this figure, it may be seen that the LLI 144 pivots in the clockwise direction at the same time as the LLO 118 pivots in the clockwise direction, each toward their respective unlocked position.

Figure 11:
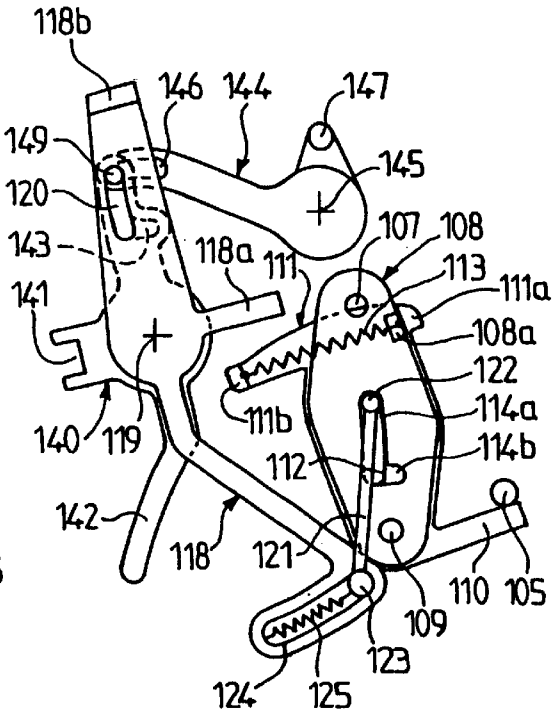
FIG. 11 is a view similar to FIG. 10, but depicting the lock in an unlocked and open condition.

Once the lever 118 has moved sufficiently for its immobilizing finger 118*a* to be no longer facing the tab 111*b*, the lever 111 is free to pivot, and pivots under the action of the energy stored up in the spring 113, and this causes the pawl peg 105 to be moved, by the branch 110 of the lever 111, as illustrated in FIG. 11. At the same time, the lever 144 continues its pivoting movement toward its unlocked condition, without impeding the pivoting of the lever 118.

When the user releases the exterior door handle, the lock returns to the condition illustrated in FIG. 6.

It may happen that a user, for example a child, pulls on the exterior door handle before another user, for example a parent, actuates the unlocking button on his or her remote-control unit. In this case, the door will open without the exterior door handle having to be pulled a second time.

It goes without saying that the embodiment of the invention which has been described hereinabove has been given by way of purely indicative and nonlimiting example and that numerous modifications may be made by the person skilled in the art without in any way departing from the scope of the invention. Thus, in particular, the helical spring 13 may be replaced by any other type of spring, for example a pneumatic spring.

What is claimed is:

1. Electrically locked/unlocked lock for a motor vehicle door, comprising:

a) a forked latch intended to interact with a striker;

b) a pawl which locks the latch in a closed position and which can adopt an "escaped" position in which the pawl no longer acts on the latch;

c) a manually operated latch-release mechanism for releasing the latch, including an outside control member which, in use, is mechanically connected to an exterior door handle of the motor vehicle door and which can undergo an actuating movement in response to actuation of the exterior door handle by a user, and which, in an unlocked condition of the lock, can, during the actuating movement of the outside control member, act on the pawl to bring the pawl into said "escaped" position;

d) an electromechanical locking/unlocking device which is mechanically coupled to the latch-release mechanism for setting the lock selectively in a locked condition in which the outside control member is unable to act on the pawl, or to an unlocked condition in which the outside control member is able to act on the pawl, the electromechanical locking/unlocking device including an electric device for actuating from the outside which reacts to an outside unlocking signal, so as to set the lock into the unlocked condition;

e) an electronic recognition device capable of producing said outside unlocking signal upon reception of an appropriate control signal from, for example, a remote control or an appropriate electronic tag device worn or carried by the owner of the vehicle or by an authorized user;

wherein the manually operated latch-release mechanism comprises an energy accumulation device which includes a spring means and which is interposed between said outside control member and said pawl in such a way that when the lock is in the locked condition, said spring means stores up energy by being stressed by said outside control member during the actuating movement of said outside control member in response to actuation of said exterior door handles and so that when the lock passes into the unlocked condition in response to said outside unlocking signal roughly at the end of the actuating travel of said outside control member, the energy stored up in said spring means is released and the energy accumulation device causes said pawl to move into the "escaped" position.

2. Lock according to claim 1, wherein said energy accumulation device further includes a first pivoting lever which is attached to said control member and can pivot about a first axis under action of said outside control member, and a second pivoting lever which can pivot on said first axis and which is coupled with the pawl so that a pivoting movement of said second pivoting lever causes the pawl to move to the "escaped" position, and wherein said spring means is mounted between the two pivoting levers.

3. Lock according to claim 2, wherein when the lock is in the unlocked condition, the electromechanical locking/unlocking device couples the first and second pivoting levers together in such a way that the first and second pivoting levers pivot together about said first axis under the action of said outside control member, and wherein, when the lock is in the locked condition, said electromechanical locking/unlocking device prevents the second pivoting lever from pivoting so that the spring means is stressed by the first pivoting lever when the first pivoting lever pivots under the action of said outside control member.

4. Lock according to claim 3, wherein the second pivoting lever has first and second tabs which are spaced apart in a tangential direction with respect to the pivoting movement of said second pivoting lever and which project from one face of said second lever some distance from said first axis, and a first oblong slot which extends in the longitudinal direction of the second pivoting lever between said first axis and the first and second tabs.

5. Lock according to claim 4, wherein the first pivoting lever passes between the first and second tabs of the second pivoting lever and has a third tab which projects from one face of the first pivoting lever some distance from said first axis and which rests against the first tab of the second pivoting lever when there is no action on the exterior door handle, and a roughly L-shaped second slot with two parts, one of the two parts of which coincides with the first oblong slot of the second lever when said third tab is resting on said first tab, and said spring means is arranged between said second and third tabs.

6. Lock according to claim 5, wherein said spring means is a helical spring.

7. Lock according to claim 6, wherein the spring is prestressed with a force which roughly corresponds to the force needed to overcome a friction between the pawl and the latch when the latch is in the closed position.

8. Lock according to claim 5, wherein said electromechanical locking/unlocking device comprises an outside locking lever which is coupled to said electric device for actuating from the outside and which can pivot on a second axle which is parallel to said first axle, said outside locking lever having an immobilizing finger which, when the lock is in the locked condition, cooperates with the second tab of the second pivoting lever to prevent the latter from pivoting.

9. Lock according to claim 8, wherein when the lock is in the locked condition, said second tab of the second pivoting lever, said immobilizing finger and the center of said second axis are aligned.

10. Lock according to claim 8, wherein said electromechanical locking/unlocking device further comprises a link rod, a first end of which is coupled to the first and second pivoting levers by a first stub which is engaged in the first and second slots of said first and second pivoting levers and causes said first and second pivoting levers to rotate as one when the lock is in the unlocked condition, and a second end of which is coupled to said outside locking lever by a second stub which is engaged in a third oblong slot made in the outside locking lever and which is at least approximately aligned with the first oblong slot of the second pivoting lever when the lock is in the unlocked condition, said second stub being able to move in said third slot against the biaising force of a spring which urges the link rod in one direction such that the first stub comes to be positioned at that one of the two ends of said first oblong slot which is furthest from said first axis.

11. Lock according to claim 8, wherein the electromechanical locking/unlocking device comprises an electrical device for actuating from the inside which reacts to a signal for unlocking from the inside so as to cause the lock to move into a condition in which it is unlocked from the inside, in which lock, actuation of an interior door handle by a user acts on the latch-release mechanism to bring the pawl into the escaped position, and reacts to a signal to lock from the inside, to cause to pass into a condition in which it is locked from the inside, in which condition, actuation of the interior door handle or a lock stalk have no effect on said release mechanism, said electromechanical locking/unlocking device comprising a lever for locking from the inside which is coupled to said electric device for actuating from the inside which is coupled to said electric device for actuating from the inside, said lever for locking from the inside being mounted so that it can pivot on an axle and having a first oblong aperture, roughly in the shape of an arc of a circle, through which there passes a drive peg which is also received in a second oblong aperture extending roughly at right angles to the first oblong aperture, in the lever for locking from the outside, so that pivoting of either said lever for locking from the inside or said lever for locking from the outside cause the free sliding of the drive peg in the oblong aperture of the other said levers namely either the lever for locking from the inside or the lever for locking from the outside.

12. Lock according to claim 11, wherein the lock comprises an additional lever for automatically unlocking from the outside when opened from the inside, said additional lever being mounted so that it can pivot on said second axis and comprising a first branch capable of cooperating with the interior door handle, said additional lever cooperating with the lever for locking from the outside to cause it to pivot into its unlocked from the outside position when the interior door handle is actuated.

13. Lock according to claim 12, wherein said additional lever comprises a second branch capable of cooperating with an interior lock stalk to cause the lever for locking from the outside to pivot into its lock from the outside position when the lock stalk is actuated into its locked from the outside position.

14. Lock according to claim 12, wherein the additional lever and the lever for locking from the outside are coupled in terms of rotation in the unlocked from the inside position and are uncoupled in terms of rotation in the locked from the inside position.

15. Lock according to claim 14, wherein the additional lever comprises a third roughly L-shaped aperture, a first part of which corresponds to said second oblong aperture of the lever for locking from the outside and a second part of which corresponds to the first oblong aperture of the lever for locking from the inside position, said third aperture having the aforementioned drive peg passing through it.

16. Lock according to claim 15, wherein the additional lever is interposed between the lever for locking from the inside and the lever for locking from the outside.

17. Lock according to claim 11, wherein the electromechanical locking/unlocking device is capable of reacting to an unlocking signal so as to cause the lock to move from a deadlocked condition into a condition in which it is unlocked from the inside and from the outside.

18. Lock according to claim 6, wherein said electromechanical locking/unlocking device comprises an outside locking lever which is coupled to said electric device for actuating from the outside and which can pivot on a second axis which is parallel to said first axis, said outside locking lever having an immobilizing finger which, when the lock is in the locked condition, cooperates with the second tab of the second pivoting lever to prevent the latter from pivoting.

19. Lock according to claim 7, wherein said electromechanical locking/unlocking device comprises an outside locking lever which is coupled to said electric device for actuating from the outside and which can pivot on a second axis which is parallel to said first axis, said outside locking lever having an immobilizing finger which, when the lock is in the locked condition, cooperates with the second tab of the second pivoting lever to prevent the latter from pivoting.

20. Lock according to claim 9, wherein said electromechanical locking/unlocking device further comprises a link rod, a first end of which is coupled to the first and second pivoting levers by a first stub which is engaged in the first and second slots of said first and second pivoting levers and causes said first and second pivoting levers to rotate as one when the lock is in the unlocked condition, and a second end of which is coupled to said outside locking lever by a second stub which is engaged in a third oblong slot made in the outside locking lever and which is at least approximately aligned with the first oblong slot of the second pivoting lever when the lock is in the unlocked condition, said second stub being able to move in said third slot against the biaising force of a spring which urges the link rod in one direction such that the first stub comes to be positioned at that one of the two ends of said first oblong slot which is furthest from said first axis.

21. Electrically locked/unlocked lock for a motor vehicle door, comprising:

a) a forked latch intended to interact with a striker;

b) a pawl which locks the latch in a closed position and which can adopt an "escaped" position in which the pawl no longer acts on the latch;

c) a mechanism for releasing the latch, including an outside control member for operating from the outside which can undergo an actuating movement in response to actuation of an exterior door handle by a user, and which, in an unlocked condition of the lock, can, during the actuating movement, act on the pawl to bring the pawl into said "escaped" position;

d) an electromechanical locking/unlocking device including an electric device for actuating from the outside which reacts at least to a signal for locking or unlocking from the outside, so as to cause the lock to move into the unlocked condition;

e) an electronic recognition device capable of producing said unlocking signal when it receives an appropriate control signal from, for example, a remote control or an appropriate electronic tag device worn or carried by the owner of the vehicle or by an authorized user;

characterized in that this lock furthermore comprises an energy accumulation device which includes a spring means and which is interposed between said control member and said pawl in such a way that when the lock is in the locked condition in which it is locked from the outside, said spring means stores up energy by being stressed by said control member during the actuating movement in response to actuation of said exterior door handle, and so that when the lock passes into the condition in which it is unlocked from the outside, in response to said unlocking signal, roughly at the end of the actuating travel of said control member, the energy stored up in said spring means is released and the energy accumulation device causes said pawl to move into the "escaped" position and wherein said energy accumulation device further includes a first pivoting lever which is attached to said control member and pivots about a first axle under action of said outside control member, and a second pivoting lever which is mounted so that it can pivot on said first axle and which cooperates with the pawl so as to carry it along with it in its pivoting movement, and wherein said spring means which is mounted between the two pivoting levers.

22. Lock according to claim 21, wherein when the lock is in the condition in which it is unlocked from the outside, the electromechanical locking/unlocking device couples the first and second pivoting levers together in such a way that the first and second pivoting levers pivot together about said first axle under the action of said outside control member, and wherein, when the lock is in the locked condition, said electromechanical locking/unlocking device prevents the second pivoting lever from pivoting so that the spring means is stressed by the first pivoting lever when the first pivoting lever pivots under the action of said outside control member.

23. Lock according to claim 22, wherein the second pivoting lever has first and second tabs which are spaced apart in a tangential direction with respect to the pivoting movement of said second pivoting lever and which project from one face of said second lever some distance from said first axle, and a first oblong &lot which extends in the longitudinal direction of the second pivoting 1 ever between said first axle and the first and second tabs.

24. Lock according to claim 23, wherein the first pivoting lever passes between the first and second tabs of the second pivoting lever and has a third tab which projects from one face of the first pivoting lever some distance from said first axle and which rests against the first tab of the second pivoting lever when there is no action on the exterior door handle, and a roughly L-shaped second slot with two parts, one of the two parts of which coincides with the first oblong slot of the second lever when said third tab is resting on said first tab, and said spring means is arranged between said second and third tabs.

25. Lock according to claim 24, wherein said spring means is a helical spring.

26. Lock according to claim 25, wherein the spring is prestressed with a force which roughly corresponds to the force needed to overcome a friction between the pawl and the latch when the latch is in the closed position.

27. Lock according to claim 24, wherein said electromechanical locking/unlocking device comprises an outside locking lever which is coupled to said electric device for actuating from the outside and which can pivot on a second axle which is parallel to said first axle, said outside locking lever having an immobilizing finger which, when the lock is in the locked condition, cooperates with the second tab of the second pivoting lever to prevent the latter from pivoting.

28. Lock according to claim 27, wherein when the lock is in the condition in which it is locked from the outside, said second tab of the second pivoting lever, said immobilizing finger and the center of said second axle are aligned.

29. Lock according to claim 27, wherein said electromechanical locking/unlocking device further comprises a link rod, a first end of which is coupled to the first and second pivoting levers by a first stub which is engaged in the first and second slots of said first and second pivoting levers and causes said first and second pivoting levers to rotate as one when the lock is in the unlocked condition, and a second end of which is coupled to said outside locking lever by a second stub which is engaged in a third oblong slot made in the outside locking lever and which is at least approximately aligned with the first oblong slot of the second pivoting lever when the lock is in the unlocked condition, said second stub being able to move in said third slot against the return force of a spring which urges the link rod in one direction such that the first stub comes to be positioned at that one of the two ends of said first oblong slot which is furthest from said first axle.

30. Lock according to claim 27, characterized in that the electromechanical locking/unlocking device comprises an electrical device for actuating from the inside which reacts to a signal for unlocking from the inside so as to cause the lock to move into a condition in which it is unlocked from the inside, in which lock, actuation of an interior door handle by a user acts on the latch-release mechanism to bring the pawl into the escaped position, and reacts to a signal to lock from the inside, to cause to pass into a condition in which it is locked from the inside, in which condition, actuation of the interior door handle or of a lock stalk have no effect on said release mechanism, said electromechanical locking/unlocking device comprising a lever for locking from the inside which is coupled to said electric device for actuating from the inside which is coupled to said electric device for actuating from the inside, said lever for locking from the inside being mounted so that it can pivot on an axle and having a first oblong aperture, roughly in the shape of an arc of a circle, through which there passes a drive peg which is also received in a second oblong aperture extending roughly at right angles to the first oblong aperture, in the lever for locking from the outside, so that pivoting of either said lever for locking from the inside or said lever for locking from the outside cause the free sliding of the drive peg in the oblong aperture of the other said levers namely either the lever for locking from the inside or the lever for locking from the outside.

31. Lock according to claim 30, characterized in that the lock comprises an additional lever for automatically unlocking from the outside when opened from the inside, said additional lever being mounted so that it can pivot on said second axis and comprising a first branch capable of cooperating with the interior door handle, said additional lever cooperating with the lever for locking from the outside to cause it to pivot into its unlocked from the outside position when the interior door handle is actuated.

32. Lock according to claim 31, characterized in that said additional lever comprises a second branch capable of cooperating with an interior lock stalk to cause the lever for locking from the outside to pivot into its lock from the outside position when the lock stalk is actuated into its locked from the outside position.

33. Lock according to claim 31, characterized in that the additional lever and the lever for locking from the outside are coupled in terms of rotation in the unlocked from the inside position and are uncoupled in terms of rotation in the locked from the inside position.

34. Lock according to claim 33, characterized in that the additional lever comprises a third roughly L-shaped aperture, a first part of which corresponds to said second oblong aperture of the lever for locking from the outside and a second part of which corresponds to the first oblong aperture of the lever for locking from the inside position, said third aperture having the aforementioned drive peg passing through it.

35. Lock according to claim 34, characterized in that the additional lever is interposed between the lever for locking from the inside and the lever for locking from the outside.

36. Lock according to claim 30, characterized in that the electromechanical locking/unlocking device is capable of reacting to an unlocking signal so as to cause the lock to move from a deadlocked condition into a condition in which it is unlocked from the inside and from the outside.

37. Lock according to claim 25, wherein said electromechanical locking/unlocking device comprises an outside locking lever which is coupled to said electric device for actuating from the outside and can pivot on a second axle which is parallel to said first axle, said outside locking lever having an immobilizing finger which, when the lock is in the locked condition, cooperates with the second tab of the second pivoting lever to prevent the latter from pivoting.

38. Lock according to claim 26, wherein said electromechanical locking/unlocking device comprises an outside locking lever which is coupled to said electric device for actuating from the outside and which can pivot on a second axle which is parallel to said first axle, said outside locking lever having an immobilizing finger which, when the lock is in the locked condition, cooperates with the second tab of the second pivoting lever to prevent the latter from pivoting.

39. Lock according to claim 28, wherein said electromechanical locking/unlocking device further comprises a link rod, a first end of which is coupled to the first and second pivoting levers by a first stub which is engaged in the first and second slots of said first and second pivoting levers and causes said first and second pivoting levers to rotate as one when the lock is in the unlocked condition, and a second end of which is coupled to said outside locking lever by a second stub which is engaged in a third oblong slot made in the outside locking lever and which is at least approximately aligned with the first oblong slot of the second pivoting lever when the lock is in the unlocked condition, said second stub being able to move in said third slot against the return force of a spring which urges the link rod in one direction such that the first stub comes to be positioned at that one of the two ends of said first oblong slot which is furthest from said first axle.

* * * * *